US010786410B2

(12) United States Patent
Venosi

(10) Patent No.: US 10,786,410 B2
(45) Date of Patent: Sep. 29, 2020

(54) BAG FOR PET BURIAL OR CREMATION OR FOR HOLDING CREMATION ASHES

(71) Applicant: Sweet Goodbye Pty Ltd, Dunsborough WA (AU)

(72) Inventor: Natalie Venosi, Dunsborough (AU)

(73) Assignee: Sweet Goodbye Pty. Ltd., Dunsborough WA (AU)

( * ) Notice: Subject to any disclaimer, the term of this patent is extended or adjusted under 35 U.S.C. 154(b) by 176 days.

(21) Appl. No.: 15/752,160

(22) PCT Filed: Dec. 9, 2016

(86) PCT No.: PCT/AU2016/051219
§ 371 (c)(1),
(2) Date: Feb. 12, 2018

(87) PCT Pub. No.: WO2017/096435
PCT Pub. Date: Jun. 15, 2017

(65) Prior Publication Data

US 2018/0235825 A1 Aug. 23, 2018

(30) Foreign Application Priority Data

Dec. 9, 2015 (AU) ..... 2015905104

(51) Int. Cl.
*A61G 17/06* (2006.01)
*A61G 17/08* (2006.01)

(52) U.S. Cl.
CPC ..... *A61G 17/06* (2013.01); *A61G 17/08* (2013.01)

(58) Field of Classification Search
CPC ..... A61G 17/06; A61G 17/08; B65D 33/06; B65D 33/16; B65D 33/25
(Continued)

(56) References Cited

U.S. PATENT DOCUMENTS 2,436,237 A * 2/1948 Brandt ..... A45C 3/06 150/154
5,341,548 A * 8/1994 Zerick ..... A22B 7/008 190/125
(Continued)

FOREIGN PATENT DOCUMENTS

AU 2006100503 A4 7/2006
CN 2666399 Y 12/2004
(Continued)

OTHER PUBLICATIONS

International Preliminary Report on Patentability and its annexes for corresponding PCT Application No. PCT/AU2016/051219 dated Jan. 16, 2018.
(Continued)

*Primary Examiner* — William L Miller
(74) *Attorney, Agent, or Firm* — Wood, Phillips, Katz, Clark & Mortimer

(57) ABSTRACT

A bag for pet burial or cremation or for holding cremation ashes comprises a sheet of material onto which or into which the deceased pet is to be received; and in one aspect a pocket within the sheet in which a farewell note can be placed. In an other aspect the sheet of material is formed into a pouch having an opening into which a deceased pet may be placed and a first flap which can be folded over the opening to close the pouch. In a further aspect there is a bag comprising a sheet of material on to which the deceased pet may be received and wrapped in the sheet; at least one set of at least one button on a periphery of at least one side of the sheet; and at least two button holes on each side of each set of the at least one button for adjustable securing of the wrapped material.

10 Claims, 8 Drawing Sheets

(58) Field of Classification Search
USPC ..... 27/1, 28; 383/13, 61.1, 61.5
See application file for complete search history.

(56) References Cited

U.S. PATENT DOCUMENTS

| | | | | | |
|---|---|---|---|---|---|
| 6,052,877 | A * | 4/2000 | Richard | A22B 7/008 | 27/1 |
| 6,574,840 | B1 * | 6/2003 | Doppel | A61G 17/00 | 27/19 |
| 7,186,025 | B2 | 3/2007 | Shepard et al. | | |
| 7,308,741 | B1 * | 12/2007 | Rydberg | A61G 17/08 | 27/1 |
| D808,609 | S * | 1/2018 | Venosi | D99/5 | |
| D809,735 | S * | 2/2018 | Venosi | D99/5 | |
| D814,138 | S * | 3/2018 | Venosi | D99/5 | |
| 9,925,470 | B1 * | 3/2018 | Palacio | A63H 3/005 | |
| 2006/0059669 | A1 * | 3/2006 | Rose | A61G 17/08 | 27/1 |
| 2009/0025194 | A1 * | 1/2009 | Pearce | A61G 17/08 | 27/1 |
| 2009/0260203 | A1 * | 10/2009 | Baumhauer | A61G 17/06 | 27/1 |
| 2010/0263178 | A1 | 10/2010 | Jensen et al. | | |
| 2018/0333319 | A1 * | 11/2018 | Venosi | A61G 17/06 | |

FOREIGN PATENT DOCUMENTS

| | | | |
|---|---|---|---|
| FR | 2779343 | A1 | 12/1999 |
| NL | 7306204 | A | 11/1974 |

OTHER PUBLICATIONS

International Search Report and Written Ppinion for corresponding PCT Application No. PCT/AU2016/051219 dated Feb. 20, 2017.

* cited by examiner

BAG FOR PET BURIAL OR CREMATION OR FOR HOLDING CREMATION ASHES

FIELD OF THE INVENTION

The present invention relates to a bag in which a deceased pet may be placed for burial or cremation, or in which cremation ashes may be kept.

BACKGROUND

Many people deeply love their pets. Sadly, pet owners usually outlive their pet and when a pet dies this sad occasion is often made easier by the owner having a ceremony in order to say goodbye to their loved pet before it is buried or cremated.

Pet burial or cremation bags are known for receiving the deceased pet for burial or cremation in the bag. Such bags usually comprise a sack portion with a draw string for closure of the bag. However pets come in a variety of sizes, and so these bags are also provided in a variety of sizes, with the size of the bag selected according to the size of the pet.

The present invention has been developed in order to provide an alternative to these sack type of bags.

Any references to documents that are made in this specification are not intended to be an admission that the information contained in those documents form part of the common general knowledge known to a person skilled in the field of the invention, unless explicitly stated as such.

In this specification the terms "comprising" or "comprises" are used inclusively and not exclusively or exhaustively.

SUMMARY OF THE INVENTION

According to the present invention there is provided a bag for pet burial or cremation or for holding cremation ashes, said bag comprising a sheet of material onto which or into which the deceased pet is to be received; and a pocket within the sheet in which a farewell note can be placed.

In an embodiment the sheet is folded over the deceased pet so that the material forms a pouch for containing the deceased pet.

In an embodiment the sheet is formed into a pouch for receiving the deceased pet.

In an embodiment the folded sheet is held closed by at least one button. In an alternative the sheet is held closed by a tied cord or ribbon.

According to the present invention there is provided a bag for pet burial or cremation or for holding cremation ashes, said bag comprising a sheet of material formed into a pouch having an opening into which a deceased pet may be placed and a first flap which can be folded over the opening to close the pouch.

In an embodiment the opening is formed by two further flaps, which when separated enable the opening to be widened and which can be overlapped and secured together.

In an embodiment the further flaps are secured together by a ribbon.

In an embodiment the first flap is secured to the overlapped, secured further flaps. In an embodiment the first flap is secured by the ribbon.

In an embodiment the first flap comprises a button loop which is secured to a button on the overlapped, secured further flaps.

In an embodiment the bag further comprises a label on which the deceased pet's name can be written.

According to the present invention there is provided a bag for pet burial or cremation or for holding cremation ashes, said bag comprising a sheet of material on to which the deceased pet may be received and wrapped in the sheet; at least one set of at least one button on a periphery of at least one side of the sheet; at least two button holes on each side of each set of the at least one button for adjustable securing of the wrapped sheet by buttoning at least one of the set of at least one button to at least one of each of the sets of one or more button holes.

In an embodiment the sheet is substantially rectangular in shape, wherein the at least one set of at least one button comprises a set of buttons adjacent each of two opposed edges of the sheet.

In an embodiment each of the buttons is attached to the sheet by thread such that it can be buttoned to two button holes. In an embodiment each of the buttons is attached by thread such that one of the button holes on each side of the respective set of buttons can be buttoned to one of the buttons.

In an embodiment the button holes that are buttoned to the respective button on each side are able to be selected according to the size of the received pet.

In an embodiment the sheet of material is an outer sheet and the bag further comprises an inner sheet that lines the outer sheet such that the received pet is able to be wrapped in the inner sheet before being wrapped in the outer sheet.

In an embodiment the inner sheet has ties that are able to be tied together to retain the wrapping of the inner sheet around the deceased pet.

In an embodiment the outer sheet is provided with a cradle. In an embodiment the cradle is provided with carry handles.

BRIEF SUMMARY OF DRAWINGS

In order to provide a better understanding of the present invention embodiments will now be described, by way of example only, with reference to the accompanying drawings, in which.

DETAILED DESCRIPTION OF EMBODIMENTS OF THE INVENTION

Figure 1:
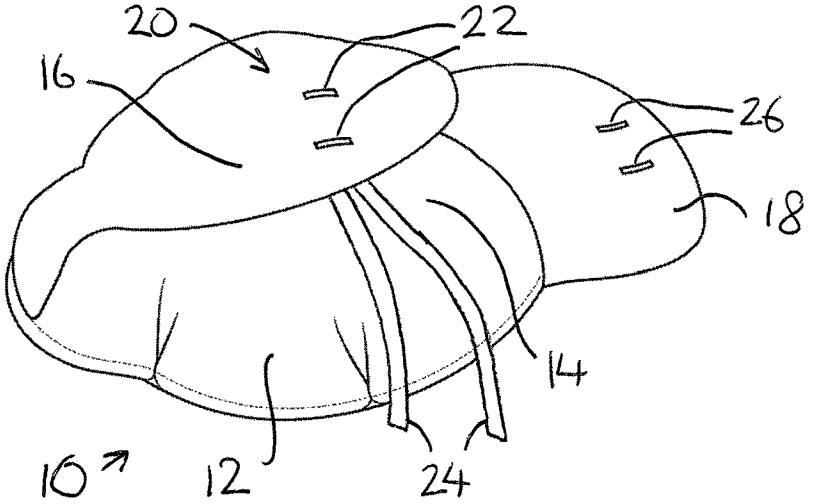
FIG. 1 is an upper perspective view of a pet burial/cremation bag according to an embodiment of the present invention.

Referring to FIG. 1 there is shown a pet burial/cremation bag 10 comprising a body 12 in the form of a pocket formed of a sheet of material, such as a plastic or a textile, including cotton or wool. The body 12 has an opening 30 into which the deceased pet may be placed and a flap 18 which can be folded over the opening 30 to close the pocket.

The opening 30 is formed by two further flaps 14 and 16, which when separated enable the opening 30 to be widened. Flap 16 overlaps with flap 14.

Figure 2:
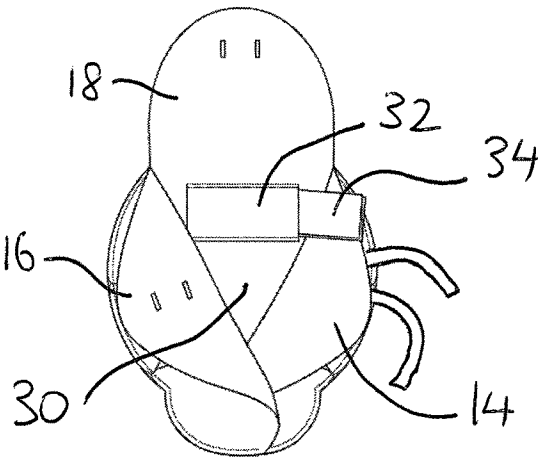
FIG. 2 is a perspective view of the bag of FIG. 1 in a configuration showing a pocket.

As seen in FIG. 2, the inside of the pocket comprises a further pocket 32 on the back wall of the inside of the pocket, and into which may be received a goodbye note written on a piece of paper 34 or the like.

Flap 14 has a ribbon or cord 24 secured to it, with two free ends extending from an upper face thereof for securing the flags to close the pocket. Flap 16 has a pair of holes 22 through which the ribbon 24 can be received. Flap 18 has a pair of holes 22 through which the ribbon 24 can be received.

Figure 3:
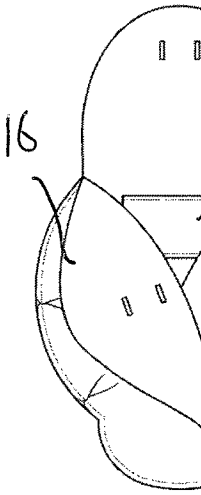
FIG. 3 is a plan view of the bag FIG. 1 with flaps opened for receiving a deceased pet.

As seen in FIG. 3, opening the flaps 14 and 16 so as to widen the opening 30 enables easier insertion of the deceased pet through the opening 30 and into the pocket 32. In an embodiment the bag further comprises a label on which the deceased pet's name can be written. The pocket 32 may operate as this label or a further label with space to write the pet's name can be provided on the outside of the bag 10.

Figure 4:
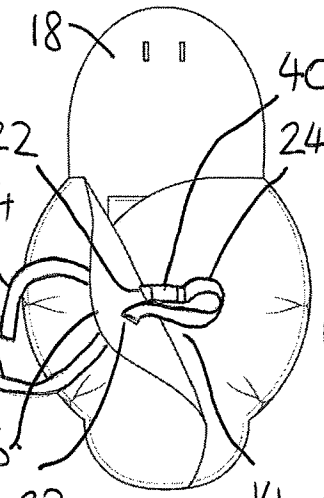
FIG. 4 is a plan view of the bag FIG. 1 with one of the flaps in a closed position.
Figure 5:
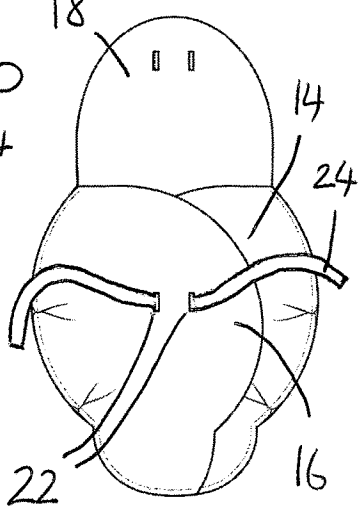
FIG. 5 is a plan view of the bag FIG. 1 with two of the flaps in a closed position.
Figure 6:
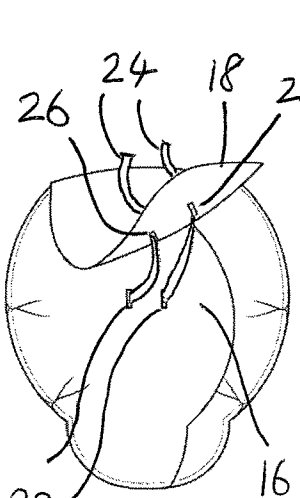
FIG. 6 is a plan view of the bag FIG. 1 with three of the flaps in a closed position.
Figure 7:
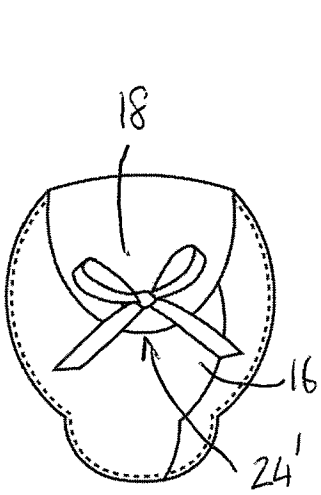
FIG. 7 is a plan view of the bag of FIG. 1 with a top flap secured in the closed position.

As can be seen in FIG. 4, when the pet is received in the pocket, flap 14 is flattened and the ribbon 24 is inserted through the holes 22 in flap 16. As seen in FIG. 5, the flap 16 is then unfolded to be flat. The ribbon ends 24 are then inserted through the holes 26 in flap 18 and flap 18 is folded over flap 16 so as to form a pouch in which the deceased pet is received. Flap 18 is then held in place by tying the ribbon as shown by 24'.

In an alternative, flap 18 may comprise a button loop spaced from the opening 30. Flap 16 would have a button able to be buttoned to the button loop when the flap 18 is folded over the opening 30.

The bag 10 may then be used in a ceremony for burial or cremation of the deceased pet or the bag may be used to hold cremation ashes of the pet.

Figure 10:
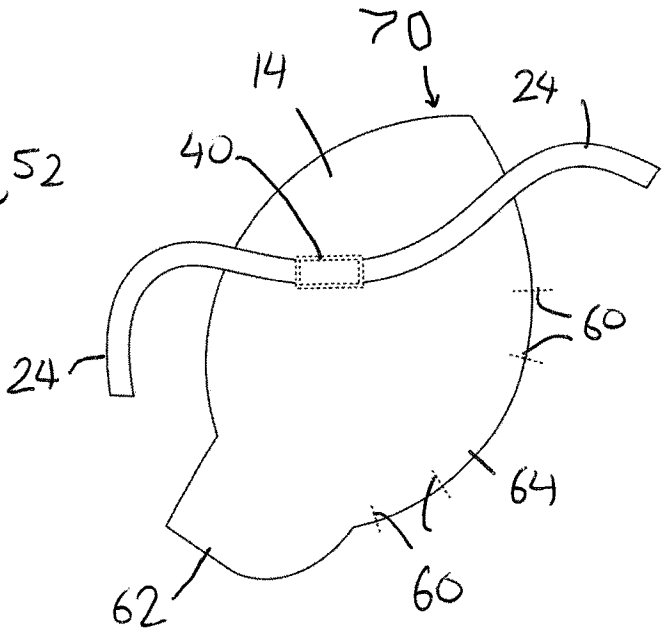
FIG. 10 is a plan view of a middle sheet of material used to form the bag of FIG. 1.
Figure 9:
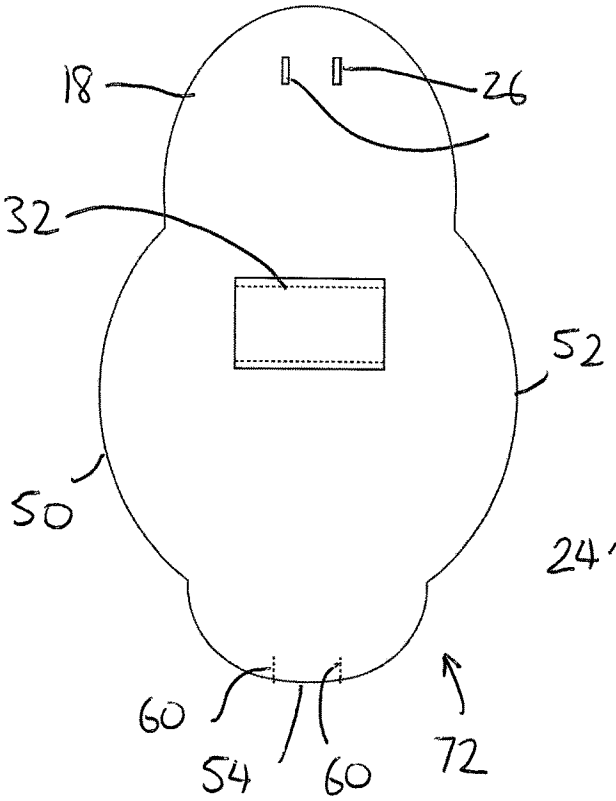
FIG. 9 is a plan view of a back sheet of material used to form the bag of FIG. 1.
Figure 8:
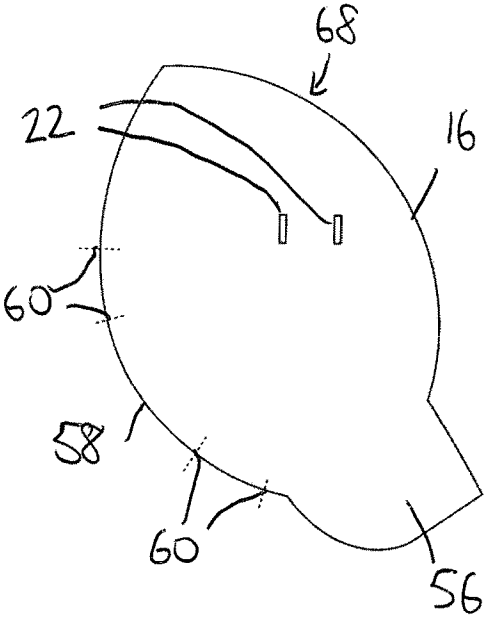
FIG. 8 is a plan view of an upper sheet of material used to form the bag of FIG. 1.

Referring to FIGS. 8 to 10, the bag 10 may be formed of three pieces, a back piece 72, a middle piece 70 and a top piece 68. Each of these are sheets of the material and are sewn together. Back piece 72 has the flap 18, two bulging sides 50 and 52 and a lobe bottom 54. Middle piece 70 has a side that forms the flap 14 and an opposite bulging side 64 and a bottom 62. The ribbon 24 is attached to the flap 14, such as by stitching or gluing. Side 64 is longer than side 52, but has positions for pleats formed by folds at lines 60. With the pleats, side 64 is substantially the same size as side 52. Top piece 68 has a side that forms the flap 16 and an opposite bulging side 58 and a bottom 56. Side 58 is longer than side 50, but has positions for pleats formed by folds at lines 60. With the pleats side 58 is substantially the same size as side 50. Bottom 54 may have pleat folds 60. With the pleat (if any) bottom 54 partly matches the bottom 62 and bottom 56 when they are overlaid. To form the bag 10, middle piece 70 is overlaid with the bottom 62 over laid with pleated bottom 54 (if applicable) and pleated side 64 overlays side 52 and these are connected together, such as by stitching. Then upper piece 68 is overlaid on the bottom 62 and pleated side 58 overlays side 50 and these are connected together, such as by stitching.

Figure 11:
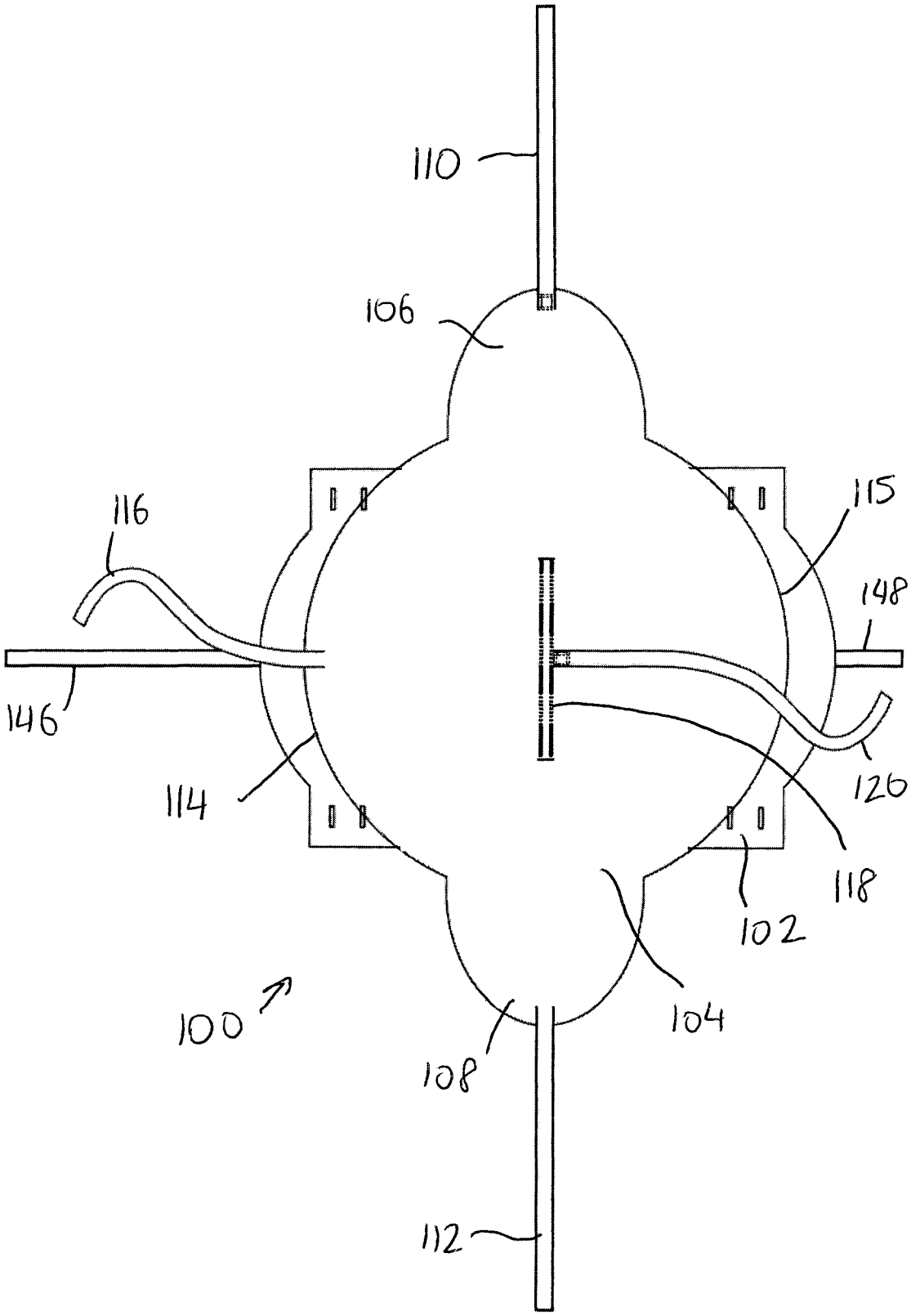
FIG. 11 is a plan view of a pet burial/cremation bag according to another embodiment of the present invention.

Referring to FIG. 11 there is shown a pet burial/cremation bag 100, which comprises a pouch portion 104. The pouch portion 104 may take the form of the body 10 described above, or in the embodiment described below, it may take the form of a first sheet 104. The pouch portion sits on or overlays a second sheet 102.

Whether or not the pouch portion 104 takes the form described above, it may still comprise the pocket 32 for receiving the goodbye note, as described above.

The sheets 102 and 104 may be formed of plastic or textile material such as wool or cotton. The first sheet 104 is substantially circular in shape with lobe portions 106, 108 extending therefrom. It will be appreciated that the shape of the first sheet 104 need not be circular. The lobes 106 and 108 extend transverse to the length of the sheet 102. The lobes 106 and 108 extend further than the width of the sheet 102. On either side of the circular portion, the sheet 104 comprises side portions 114 and 115. The side portions 114 and 115 extend substantially in-line with the length of the sheet 102. Side portion 114 has a tie 116. A further tie 120 extends over side 115. It is preferred that the tie 120 extends substantially from the centre of the circular portion, but it may extend from a portion closer to the side 115. Lobe portions 106 and 108 each have ties 110 and 112, respectively extending therefrom.

Figure 12:
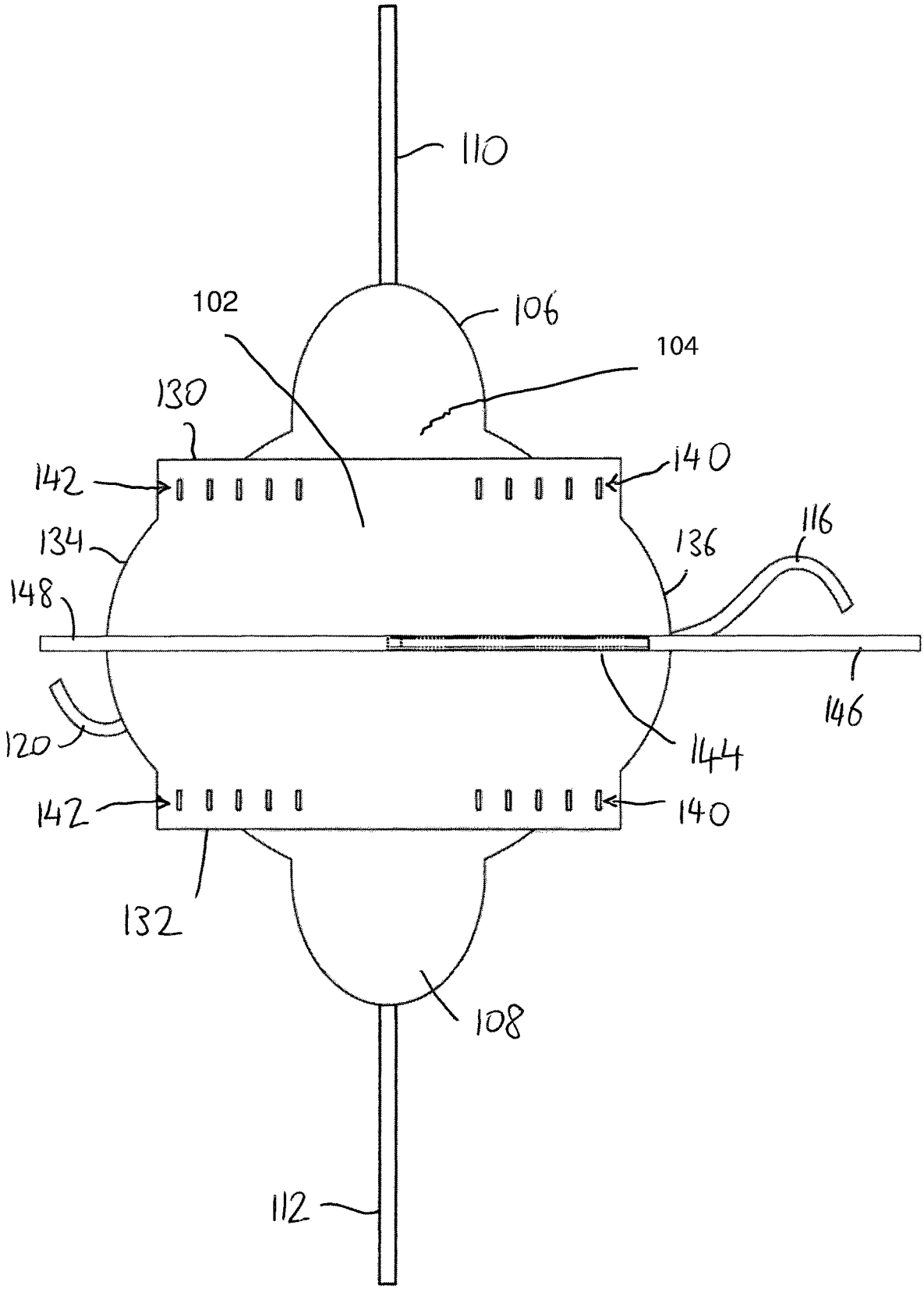
FIG. 12 is a rear plan view of the bag of FIG. 11.
Figure 18:
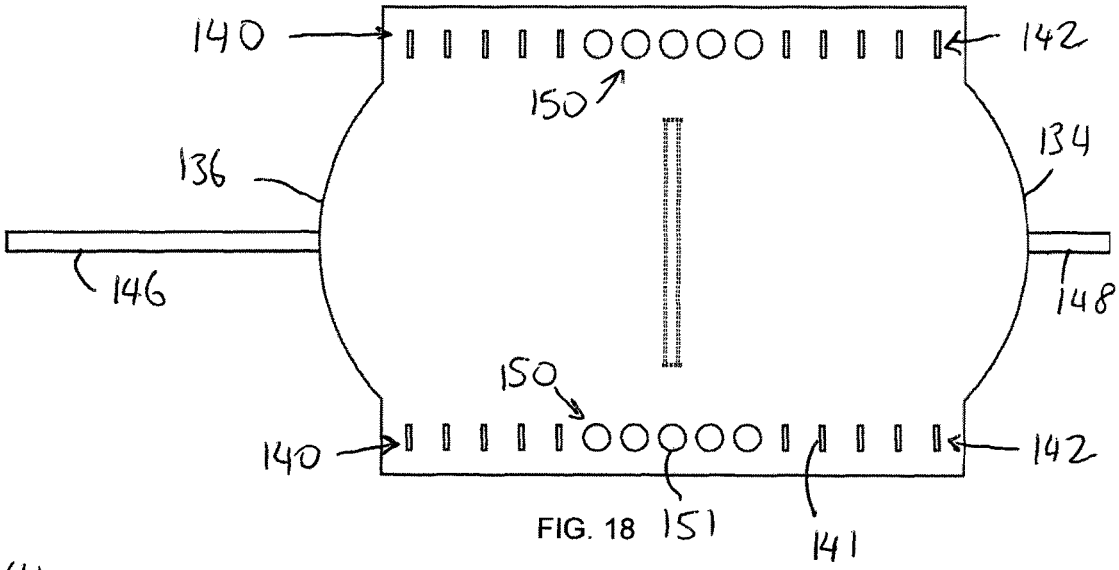
FIG. 18 is a plan view of the outer sheet of the bag of FIG. 11 (inner sheet removed)

Second sheet 102 is better seen in FIGS. 12 and 18. It is elongate and substantially rectangular in shape, although it will be appreciated that it could take another shape. The second sheet 102 comprises lobe proportions 134 and 136 at each end. Sheet 102 has longitudinally extending sides 130 and 132. Extending from the end comprising lobe 136 is a tie 146. A further tie 148 extends over end comprising lobe 134. It is preferred that the tie 148 extends substantially from the centre of the sheet 102, but it may extend from a portion closer to the end 134. Ties 146 and 148 may be formed from a single piece of ribbon or the like which is attached to the sheet 102 by stitching 144.

Extending along a periphery of at least one of the sides and preferably both sides 130, 132 of the sheet 102 are at least one set 150 of at least one button 151. In this embodiment there are 5 buttons. In FIG. 11 the set of buttons 150 are covered by the sheet 104. The set of buttons 150 can be seen in FIG. 14 when the sheet 104 is folded away. On each side of each set of buttons 150, and in-line with the set of buttons 150, is a set 140 and 142 of at least two button holes 141. In this embodiment there are 5 button holes in each of the sets 140, 142. Preferably each of the buttons 151 is attached to the sheet 102 by sufficient thread such that it can be buttoned to two button holes 141.

In an embodiment the first sheet 104 is attached to the second sheet, preferably by stitching 118.

Figure 13:
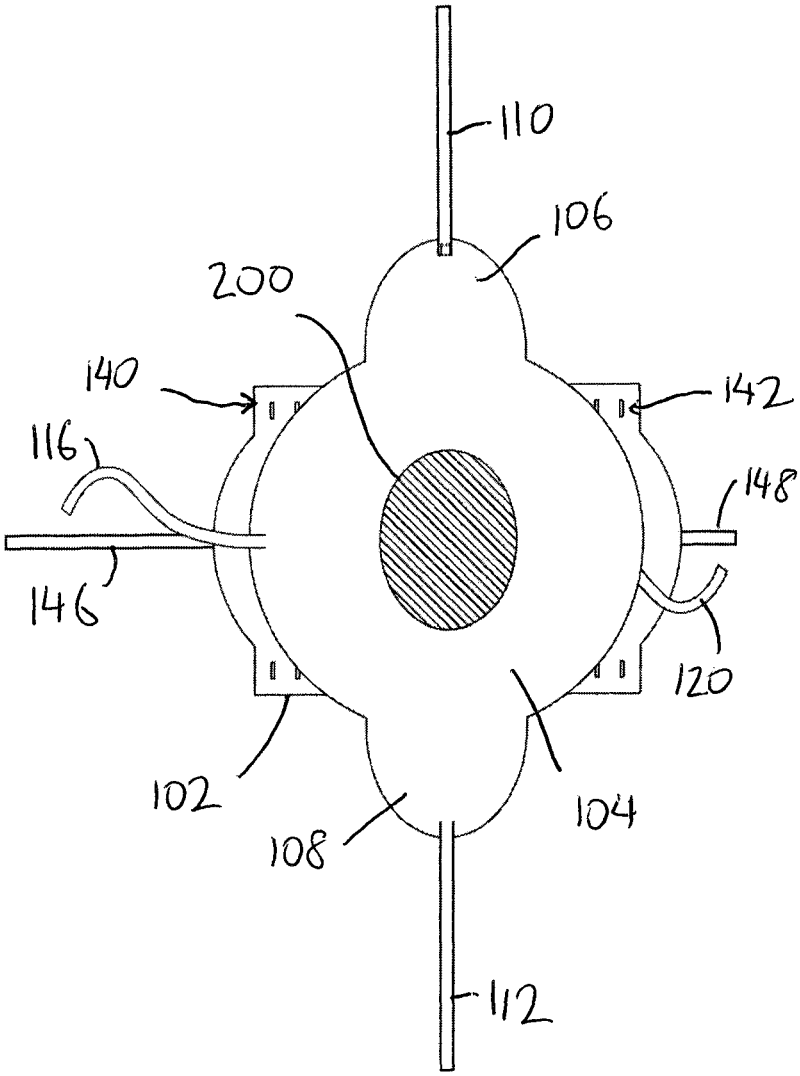
FIG. 13 is a plan view of the bag of FIG. 11 in use receiving a representation of a deceased pet.

The size of the bag 100 is selected according to the size of the deceased pet, noting that for a given size of bag a range of sizes of deceased pet can be accommodated as will be described below. First sheet 104 is large enough to receive the deceased pet. As shown in FIG. 13, the deceased pet 200 is placed transverse to the length of second sheet 102 and extending between lobes 106 and 108 so that the pet's sides face side portions 114 and 115 of the sheet 104.

Opposite side portions 114 and 115 may be folded over the deceased pet, preferably with side 114 folded first, and with side 115 folding over side 114. Depending on the size of the pet, the side portions 114 and 115 may not meet, may just meet or they may overlap. With the side portions 114 and 115 folded over the deceased pet, the ties 116 and 120 are tied together holding the side portions 114 and 115 in position across the pet.

Figure 14:
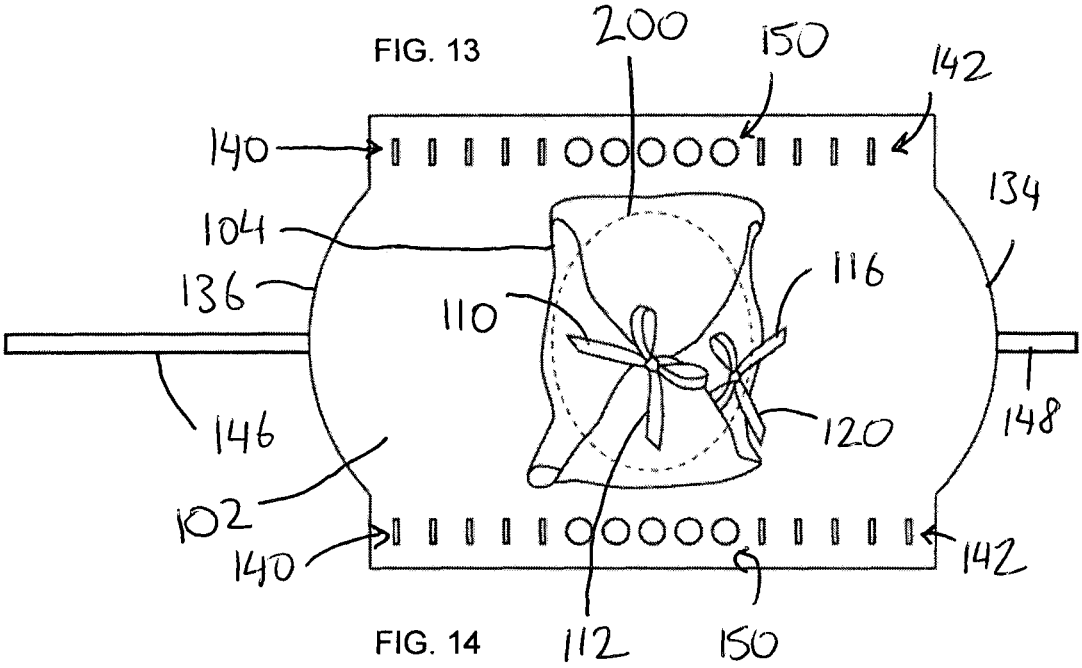
FIG. 14 is a plan view of the bag of FIG. 11 in use in which an inner sheet is wrapped around the representation of the deceased pet.

The lobe portions 106 and 108 are then folded over the folded side portions 114 and 115. The ties 110 and 112 and then tied together so as to hold the lobe portions 106 and 108 in place over the side portions 114 and 115. The first sheet 104 now forms a pouch and the deceased pet 200 is securely cocooned within the pouch formed by the folded first sheet 104 as indicated in FIG. 14.

Figure 15:
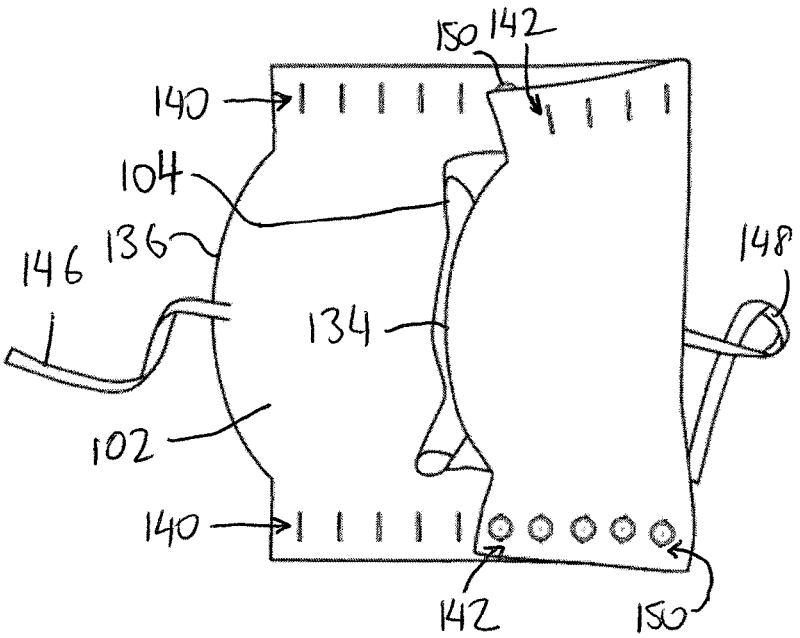
FIG. 15 is a plan view of the bag of FIG. 11 in use in which a part of an outer sheet is wrapped around the inner sheet.

The second sheet 102 may be folded as follows. One of the lobe portions 134, 136, and preferably 134, is folded over the pouch as indicated in FIG. 15. Depending on the size of the pet and thus the pouch, it may be tucked under the side of the pouch. The set 142 of button holes 140 on this side of the sheet 102 are then buttoned to one or more of the set of buttons 150. FIG. 15 shows the bottom set of buttons have been buttoned and the top set of buttons are yet to be buttoned. The buttons are buttoned to the closest aligning set of button holes according to the size of the pet and thus the pouch.

Figure 16:
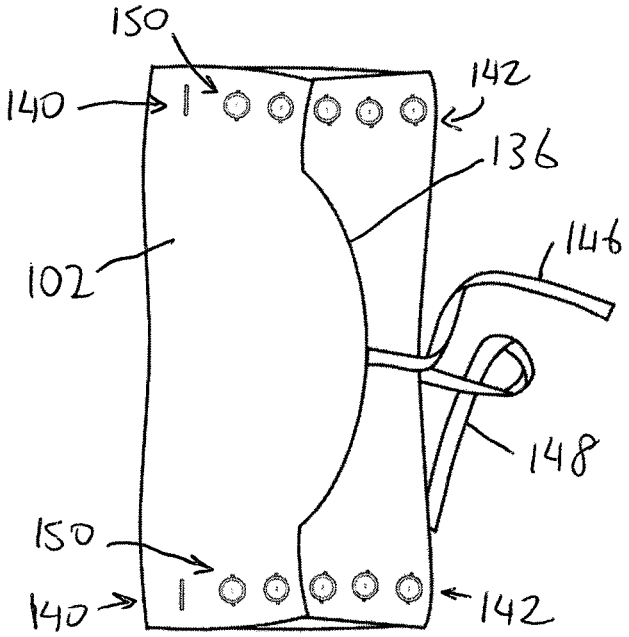
FIG. 16 is a plan view of the bag of FIG. 11 in use in which the outer sheet is wrapped around the inner sheet.

Then the opposite lobe, in this case lobe 136, is folded over the pouch and the set 140 of button holes 141 is buttoned to the buttons 150 according to the nearest alignment of holes to buttons. Depending on the size of the pet and thus the pouch containing the pet, the lobe 136 may overlap lobe 134 as is the case in FIG. 16.

Figure 17:
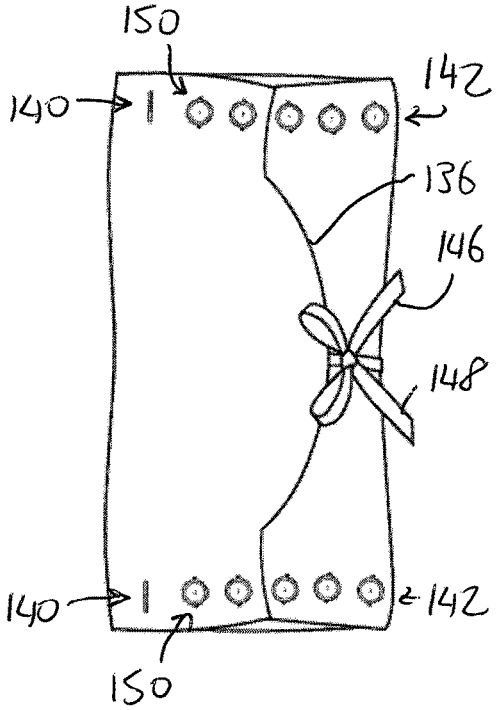
FIG. 17 is a plan view of the bag of FIG. 11 in use in which the outer sheet is secured.

The ties 146 and 148 may then be tied together securing the lobe 136 in place, as shown in FIG. 17. The pet will there then be secured within the pouch which is then contained within an outer cocoon formed by the buttoned second sheet 102.

Figure 19:
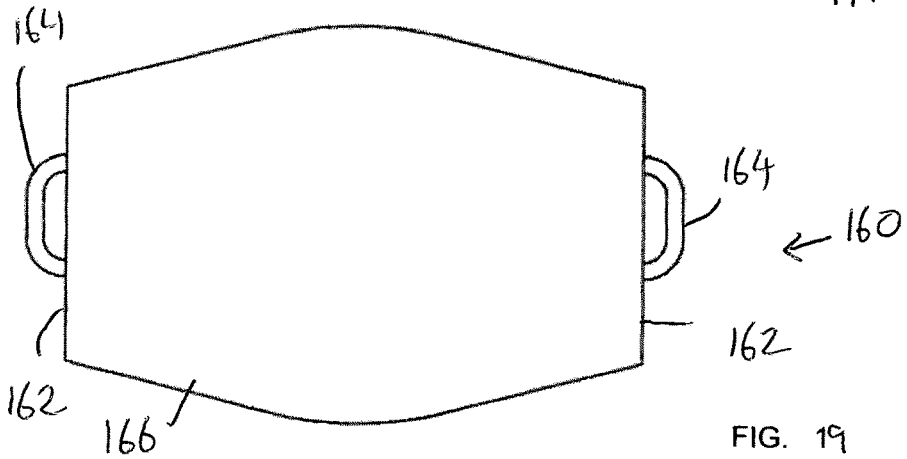
FIG. 19 is a plan view of a carrying cradle for the bag of FIG. 11.
Figure 20:
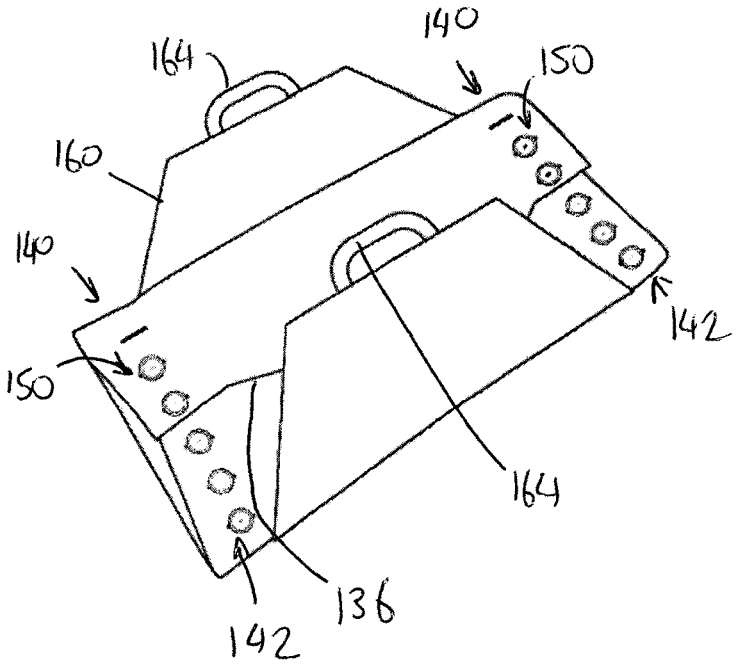
FIG. 20 is a perspective view of the cradle of FIG. 19 carrying the folded bag of FIG. 11.

Referring to FIGS. 19 and 20 the bag 100 may be provided with a cradle 160 to assist in carrying the bag 100. The cradle 160 may be separate, but preferably is attached such as by stitching to the back of the sheet 102. The cradle 160 is formed of a sheet of heavier fabric, such as canvas, and is generally elongate in shape with handles 164 at each end. Once the bag 100 is folded to the form shown in FIG. 17 it can be carried in the cradle as shown in FIG. 20.

In the case of the pet being large all of the button holes 140, 142 may not be able to extend across all of the buttons 150. In this case the buttons 150 are divided so that up to half of the buttons are attached to the first set of buttonholes 140 and up to half of the remaining buttons 150 may be buttoned to the second set of buttonholes 142. Thus the buttons on each side are able to be selected according to the size of the received pet. This will arrange the lobes 134 and 136 so as to be in contact with each other.

The bag 100 may then be used in a ceremony for burial or cremation of the deceased pet.

Figure 23:
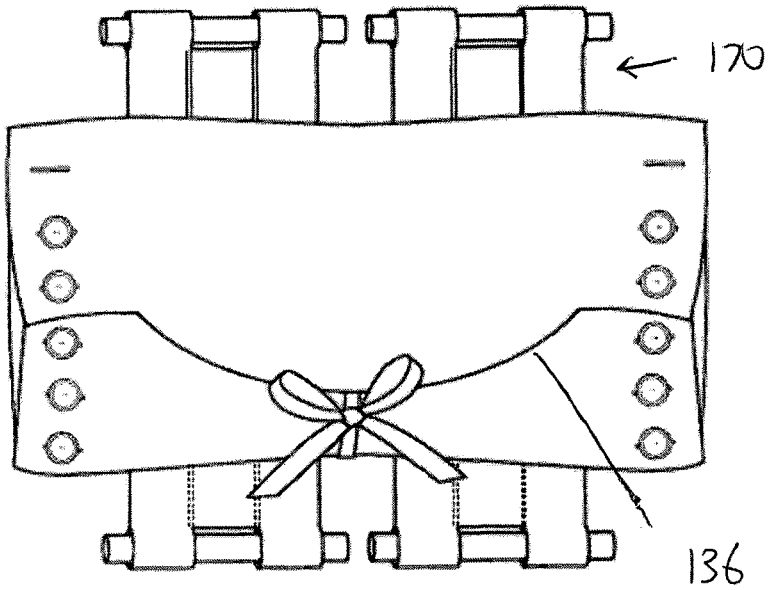
FIG. 23 is a plan view of the cradle of FIG. 21 carrying the folded bag of FIG. 11.
Figure 22:
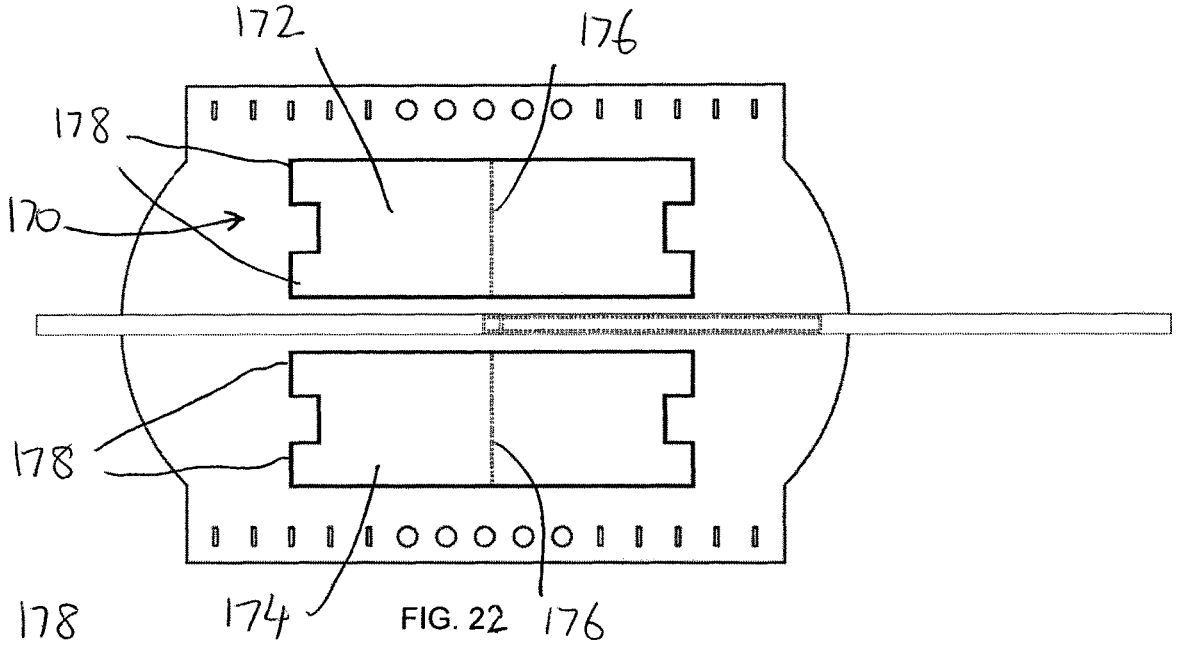
FIG. 22 is a rear plan view of the outer sheet of the bag of FIG. 11 with two of the cradles of FIG. 21 attached.
Figure 21:
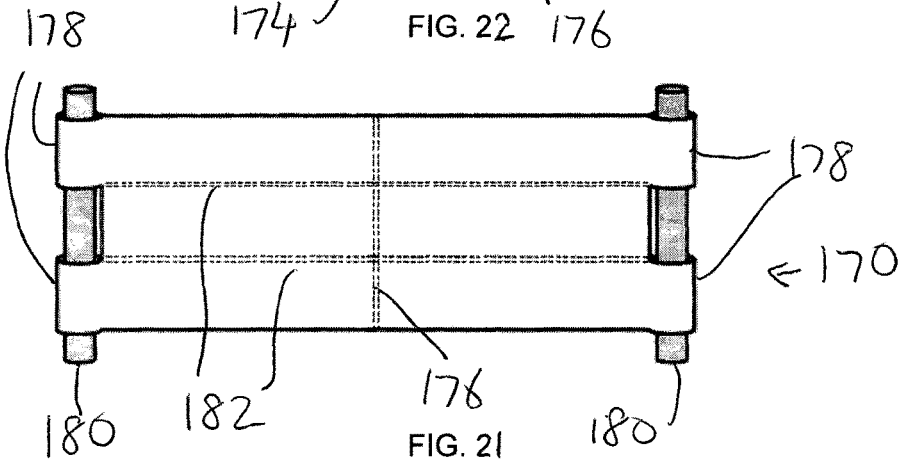
FIG. 21 is a plan view of a carrying cradle for the bag of FIG. 11.

In the case of a large pet a more robust cradle 170 may be used. In this embodiment the cradle 170 comprises looped ends 178, through which a dowel or similar rod may be inserted as handles. The cradles 170 may be attached to the rear of the second sheet by stitching 176 as indicated in FIG. 22. The bag 100 may then be carried as indicated in FIG. 23. This form of cradle may be used in the smaller form. Loops of material or the rods may be used with one or two on each side (or other configuration).

Modifications may be made to the present invention within the context of that described and shown in the drawings. Such modifications are intended to form part of the invention described in this specification.

What is claimed is:

1. A pet burial/cremation bag for a deceased pet said bag comprising a sheet of material on to which the deceased pet or cremation ashes thereof may be received and wrapped in the sheet; at least one set of at least one button on a periphery of at least one side of the sheet; at least two button holes on each side of each set of the at least one button for adjustable securing of the wrapped sheet.

2. The pet burial/cremation bag according to claim 1, wherein the sheet is substantially rectangular in shape, wherein the at least one set of at least one button comprises a set of buttons adjacent each of two opposed edges of the sheet.

3. The pet burial/cremation bag according to claim 2, wherein each of the buttons is attached to the sheet by thread and can be buttoned to two button holes.

4. The pet burial/cremation bag according to claim 3, wherein each of the buttons is attached to the sheet by thread such that one of the button holes on each side of the respective set of buttons can be buttoned to one of the buttons.

5. The pet burial/cremation bag according to claim 2, wherein the button holes that are buttoned to the respective button on each side are able to be selected according to the size of the received pet.

6. The pet burial/cremation bag according to claim 2, wherein the sheet of material is an outer sheet and the bag further comprises an inner sheet that lines the outer sheet such that the received pet is able to be wrapped in the inner sheet before being wrapped in the outer sheet.

7. The pet burial/cremation bag according to claim 6, wherein the inner sheet has ties that are able to be tied together to retain the wrapping of the inner sheet around the deceased pet.

8. The pet burial/cremation bag according to claim 6, wherein the outer sheet comprises a cradle.

9. The pet burial/cremation bag according to claim 8, wherein the cradle comprises carry handles.

10. The pet burial/cremation bag according to claim 1, further comprising a pocket configured to receive a note.

* * * * *